United States Patent [19]

Horváth

[11] Patent Number: 4,677,265

[45] Date of Patent: Jun. 30, 1987

[54] GAS-BLAST CIRCUIT BREAKER

[75] Inventor: Imre Horváth, Riedt-Neerach, Switzerland

[73] Assignee: BBC Brown, Boveri & Company, Limited, Baden, Switzerland

[21] Appl. No.: 857,136

[22] Filed: Apr. 29, 1986

[30] Foreign Application Priority Data

May 20, 1985 [CH] Switzerland ..... 2134/85

[51] Int. Cl.[4] ..... H01H 33/72

[52] U.S. Cl. ..... 200/148 B; 200/148 R; 200/245; 200/248; 200/253; 200/257; 200/260; 200/258

[58] Field of Search ..... 200/148 B, 148 R, 245, 200/248, 250, 252, 253, 257, 258, 260

[56] References Cited

U.S. PATENT DOCUMENTS 2,806,926 9/1957 Rigert et al. ..... 200/257

4,570,202 2/1986 Nishida et al. ..... 200/148 B

*Primary Examiner*—Robert S. Macon

*Attorney, Agent, or Firm*—Burns, Doane, Swecker & Mathis

[57] ABSTRACT

The gas-blast circuit breaker preferably provided for switching medium voltage has a housing (1) filled with insulating gas. In this housing (1), two contact members (7, 8) are arranged which can be moved relative to each other along an axis (6), and a fixed (8) one of which is formed of two half-shells (11, 12) spaced apart from each other along a plane of separation (16). A power terminal (5), arranged transversely to the axis (6), is electrically conductively connected to the fixed contact member (8). This circuit breaker is to be simplified while retaining a reliable current transfer from the power terminal (5) to the fixed contact member (8). This is achieved by the fact that the current feed (5) is constructed to be cylindrical and is brought to the half-shells (11, 12) in the plane of separation (6), and that the lengths of the half-shells (11, 12) in the direction of the axis (6) between the power terminal (5) and contact points (17, 18, 19, 20) with the moving contact member (7) have such dimensions that the repelling and attracting current forces occurring at the system of power terminal (5), half-shells (11, 12) and moving contact member (7) essentially compensate each other.

7 Claims, 4 Drawing Figures

GAS-BLAST CIRCUIT BREAKER

FIELD OF THE INVENTION

The invention relates to gas-blast circuit breakers.

BACKGROUND OF THE INVENTION

Such a circuit breaker is described in Swiss patent application No. 4015/84-0 of Aug. 22, 1984. The known circuit breaker is provided with a housing filled with insulating gas and containing two contact members which are located in the interior of the housing and which can be moved relative to each other along one axis. To achieve a short constructional length, the power terminals of this circuit breaker enter diametrically with respect to the axis the interior of the housing and are there taken to the contact members transversely with respect to the axis. In this arrangement, a reliable transfer of power from the power terminal to the fixed contact member is achieved by two half-shells forming the fixed contact member and spaced apart from each other along a plane of separation, and by two flat bars arranged parallel to each other and brought to one of the two half-shells in each case as a power connection.

OBJECTS AND SUMMARY OF THE INVENTION

The object of the invention is to simplify the gas-blast circuit breaker of the generic type while retaining a reliable transfer of power from the power terminal to the fixed contact member.

The gas-blast circuit breaker according to the invention is characterized by the fact that its contact system is of simple construction and can be exchanged without problems. At the same time, reliable transfers of power from the power terminal to the fixed contact member and from the fixed contact member to the moving contact member are always achieved in a simple manner, independently of the current to be conducted. Additional contact springs can therefore have extremely weak dimensions.

Advantageous developments of the invention are specified in the dependent claims.

BRIEF DESCRIPTION OF THE DRAWING

In the text which follows, the invention is explained in greater detail with the aid of a preferred embodiment illustrated in the drawing, in which.

Figure 1:
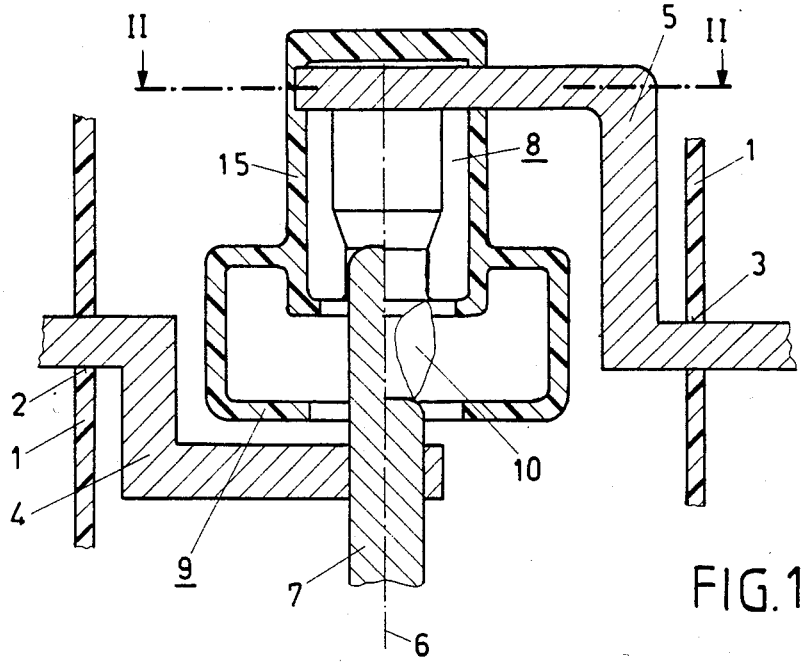
FIG. 1 shows a top view of section along line I—I of FIG. 2 through an illustrative embodiment of the gas-blast circuit breaker according to the invention.

The gas-blast circuit breaker shown in FIG. 1 is provided with a housing 1 filled with insulating gas such as sulfurhexafluoride at a pressure of a few bars. At mutually opposite sides of the housing 1, penetrations 2 and 3 are provided, through which in each case one power terminal 4 and 5 is carried into the interior of the housing 1 for a cylindrical contact member 7, which can be moved along an axis 6, and a fixed contact member 8 of hollow cylindrical construction. The power terminal 4 is connected via a sliding contact, not shown, to the moving contact member 7, whereas the power terminal 5 is connected directly to the fixed contact member 8. Both contact members 7, 8 are constructed to be resistant to arc erosion and contact each other in the closed position in the interior of a hollow body 9 of insulating material (left-hand part of FIG. 1). During the opening process, the moving contact member 7 is moved out of the fixed contact member 8 located in the interior of the body 9 of insulating material and a switching arc 10, burning in the interior of the body 9 of insulating material and, in doing so, increasing the pressure of the insulating gas, is drawn between the fixed contact member 8 and moving contact member 7 (right-hand part of FIG. 1).

Figure 2:
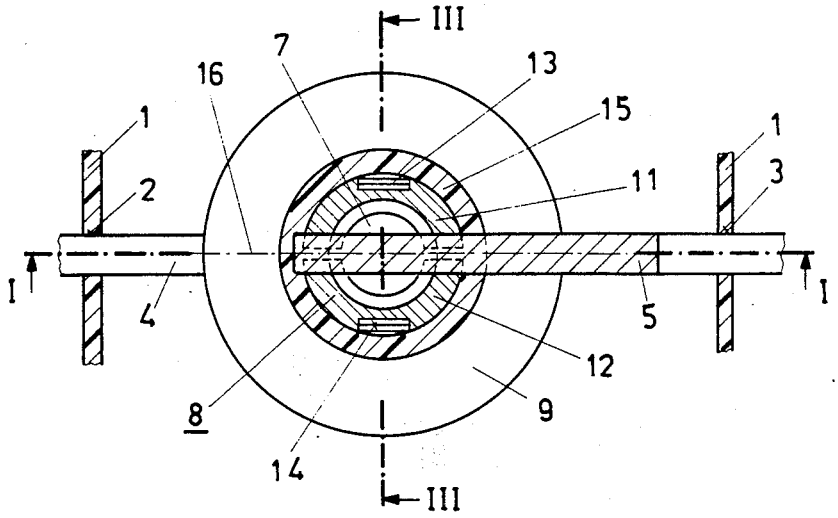
FIG. 2 shows a top view of a section along line II—II of FIG. 1.

As can be seen from FIG. 2, the fixed contact member 8 is built up of two parts which are constructed as half-shells 11 and 12. The two half-shells 11 and 12 are supported on diametrically opposite sides on compression springs 13 and 14 respectively, which, in turn, are supported in a cylindrical part of the body 9 of insulating material acting as a cage 15. The two half-shells 11 and 12 are spaced apart from each other by a plane of separation 16 extended along the axis 6.

Figure 3:
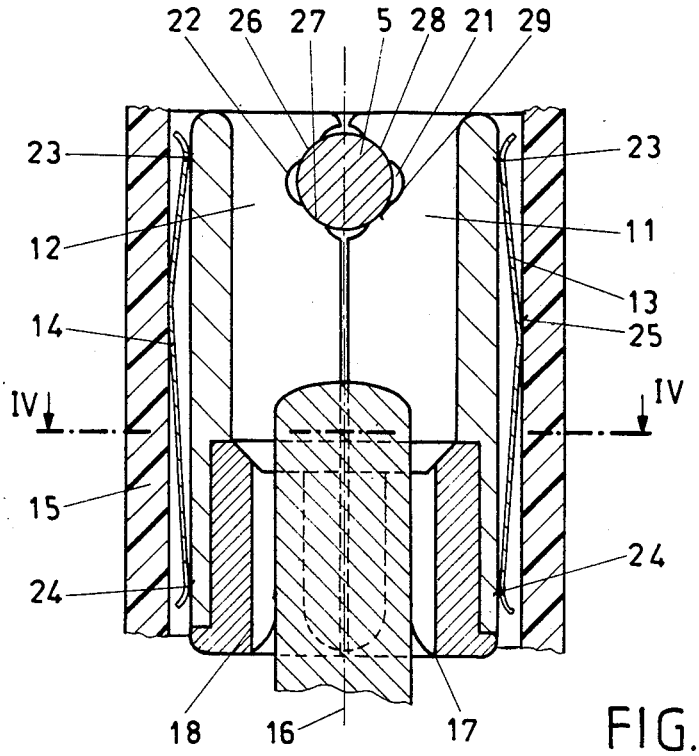
FIG. 3 shows a top view of a section along line III—III of FIG. 2 through the illustrative embodiment, shown on an enlarged scale, of the gas-blast circuit breaker according to the invention.
Figure 4:
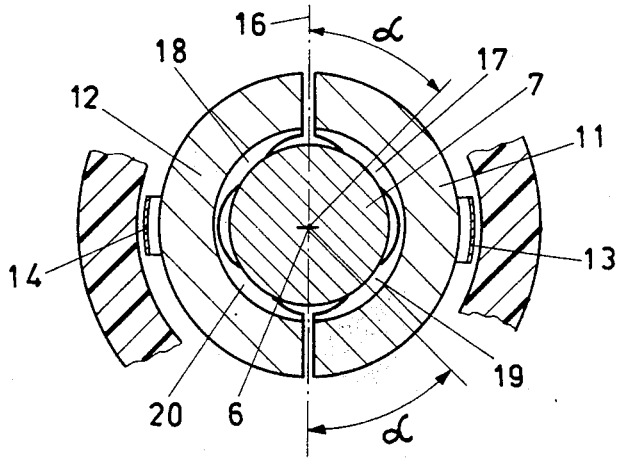
FIG. 4 shows a top view of a section along line IV—IV of FIG. 3.

It can be seen from FIGS. 3 and 4 that two contact points 17, 19 and 18, 20 of arc-erosion-resistant material such as tungsten copper, pointing radially inward and extending along the axis 6 and contacted by the moving contact member 7 during the closing process are inserted into the half-shells 11 and 12 preferably consisting of copper, and that the power terminal 5 is of cylindrical construction and is essentially supported perpendicular to the axis 6 in the plane of separation 16 in recesses 21 and 22 in the material of the fixed contact member 8. These material recesses 21, 22 are located at the ends facing away from the contact points 17, 18, 19, 20 of the half-shells 11, 12. In the closed position, the half-shells 11, 12 are supported on the power supply 5 with a pressure predetermined by the compression springs 13, 14 by their parts delimiting the material recesses 21, 22, and on the moving contact member 7 with the contact points 17, 18, 19, 20. To compensate for the repelling forces of the current transfers of the power terminal 5 on the half-shells 11 and 12 and of the half-shells 11 and 12 on the moving contact member 7, it is recommended to select the lengths of the half-shells 11, 12 in the direction of the axis 6 between the material recesses 21, 22 and the contact points 17, 18, 19, 20 to be least equal to 1 to 1.5 times but at a maximum, equal to 2 to 2.5 times the mean diameter of the half-shells 11, 12. It is then possible to achieve contact forces which are adequate for large and small currents between the power terminal 5 and the half-shells 11, 12 and between the half-shells 11, 12 and the moving contact member 7 with only the spring forces of the compression springs 13, 14.

If the compression springs 13, 14 are constructed to be leaf springs as described in the present illustrative embodiment, whose one ends rest on the outsides of the half-shells 11, 12 in points 23 in the area of the power terminal 5, and whose other ends rest on the outsides of the half-shells 11, 12 in points 24 in the area of the contact points 17, 18, 19, 20, contact forces having different effects can be achieved in a simple manner by the fact that support points 25 of the compression springs 13, 14 on the cage 15 are formed at different distances from the support points 23 and 24.

The arrangement of the two contact points 17, 19 and 18, 20 is preferably symmetrical and in each case rotated by an angle $\alpha$ of 30° to 70° with respect to the plane of separation 16 around the axis 6 on each of the two half-shells 11 and 12. If the angle $\alpha$ is selected to be comparatively small, for example about 40°, the comparatively large components of the repelling current forces caused by the transfer of current from the half-shells 11 and 12 to the moving contact member 7 and acting parallel to the plane of separation 16 cancel and the component of the repelling current forces acting perpendicularly to the plane of separation 16 will be comparatively small. With the predetermined position of the half-shells 11, 12, a reliable two-line contact will always be available with a comparatively small spring force of the compression springs 13 and 14, independently of the intensity of the current to be conducted or to be switched.

As can be seen from FIG. 3, the current can be transferred from power terminal 5 to the half-shells 11 and 12 in a corresponding manner by means of contact points 26, 27, 28, 29. These contact points are configured and arranged in accordance with the contact points 17, 18, 19, 20 with respect to the power terminal 5. With a suitable arrangement, these contact points will also reduce the repelling current forces occurring during the transfer from the power terminal 5 to the half-shells 11, 12, as a result of which the required spring forces of the compression springs 13, 14 can be kept comparatively small even in the area of the end of the half-shells 11, 12 provided with the conductive connection 5.

What is claimed is:

1. A gas-blast circuit breaker comprising:

a housing adapted to be filled with insulating gas and having an axis;

a first cylindrical contact member;

means mounting said first member for movement along said axis in said housing, a second contact member, said second member being in the form of a hollow cylinder and being located in said housing, said second contact member being formed of two half-shells spaced from each other along a plane of separation, each of said half-shells being formed with an inside surface, said inside surfaces facing each other and having contact points which rest against said first contact member when the circuit breaker is in a closed position, a first power terminal extending transversely to said axis and connected to said movable contact member, and a second power terminal extending transversely to said axis and connected to said second contact member, said second power terminal having a cylindrical construction and being in contact with said half-shells in said plane of separation, said half-shells having lengths in the direction of said axis between said second power terminal and said contact points such that repelling current forces occurring at both the point of current transfer between said second power terminal and said half-shells and at the point of current transfer between said half-shells and said moving contact member essentially compensate for the attracting current forces acting between said half shells.

2. The gas-blast circuit breaker according to claim 1, wherein said half-shells are formd with a mean diameter, said length of said half-shells being at least equal to said mean diameter and less than 2.5 times said mean diameter.

3. The gas-blast circuit breaker according to claim 1, wherein said half-shells are formed with mutually opposite material recesses, said second power terminal resting in said recesses.

4. The gas-blast circuit breaker according to claim 3, wherein said half-shells each have two ends which are supported on a compression spring extending parallel to said axis.

5. The gas-blast circuit breaker according to claim 4, wherein a cage having an inside wall is provided around said half-shells, said compression spring being of leaf-shaped construction and having one support point in contact with said inside wall to support said compression spring on said inside wall.

6. The gas-blast circuit breaker according to claim 2, wherein two of said contact points are provided in each of said half-shells, said contact points extending parallel to said axis and pointing radially inward, said contact points being formed of arc erosion-resistant material such as tungsten copper.

7. The gas-blast circuit breaker according to claim 6, wherein said contact points are arranged symmetrically with respect to said plane of separation and in each case are positioned at an angle of 30° l to 70° with respect to said plane of separation.

* * * * *